United States Patent [19]

Maudal et al.

[11] Patent Number: 4,561,357

[45] Date of Patent: Dec. 31, 1985

[54] STEERING MECHANISM FOR AN EXPLOSIVELY FIRED PROJECTILE

[75] Inventors: Inge Maudal, Huntington Beach; Byron M. Niemeier, Claremont; Larry D. Wedertz, Mira Loma, all of Calif.

[73] Assignee: General Dynamics Pomona Division, Pomona, Calif.

[21] Appl. No.: 418,142

[22] Filed: Sep. 15, 1982

[51] Int. Cl.[4] ..... F41G 9/00; F42B 13/02; F42B 15/00

[52] U.S. Cl. ..... 102/439; 244/3.11; 244/3.26; 244/3.3

[58] Field of Search ..... 244/3.3, 3.26, 3.14, 244/3.21, 3.19, 3.11, 3.24; 89/1 A; 102/384, 439, 348

[56] References Cited

U.S. PATENT DOCUMENTS

| | | | |
|---|---|---|---|
| 656,933 | 8/1900 | Brown . | |
| 1,277,225 | 8/1918 | Lavesen | 102/384 |
| 1,324,433 | 12/1919 | Phillips, Jr. . | |
| 1,384,868 | 7/1921 | Sperry et al. . | |
| 1,388,932 | 8/1921 | Centervall | 102/384 |
| 1,537,713 | 5/1925 | Sperry et al. . | |
| 2,297,130 | 9/1942 | Bomar . | |
| 2,359,515 | 10/1944 | Fanger . | |
| 2,423,090 | 7/1947 | Fink et al. . | |
| 2,579,823 | 12/1951 | Homrighous | 102/384 |
| 2,589,129 | 3/1952 | Ponder et al. . | |
| 2,792,190 | 5/1957 | Seibold | 244/3.11 |
| 2,976,805 | 3/1961 | Africano et al. . | |
| 3,020,457 | 2/1962 | Kelley | 244/3.14 |
| 3,179,052 | 4/1965 | Jasse . | |
| 3,267,854 | 8/1966 | Michelson . | |
| 3,292,879 | 12/1966 | Chilowsky . | |
| 3,412,962 | 11/1968 | Killian . | |
| 3,713,607 | 1/1973 | Hill et al. . | |
| 3,764,091 | 10/1973 | Crowhurrst . | |
| 3,888,175 | 6/1975 | Dusoe et al. . | |
| 4,431,147 | 2/1984 | Paley | 244/3.3 |

FOREIGN PATENT DOCUMENTS

| | | |
|---|---|---|
| 492123 | 3/1919 | France . |
| 1459354 | 10/1966 | France . |

*Primary Examiner*—Charles T. Jordan

*Attorney, Agent, or Firm*—Henry M. Bissell; Edward B. Johnson

[57] ABSTRACT

A projectile trajectory correction system, the projectile itself including a unique steering arrangement. The projectile, initially part of a shell cartridge, is fired, and its position is automatically sensed. A corrected trajectory necessary to hit a target is calculated and data commands are transmitted to the projectile. The data command signals are sensed by an antenna on the projectile. The antenna in turn generates a signal which is fed to the projectile steering mechanism which is deflected in response thereto to steer the projectile onto the correct trajectory. The steering mechanism includes an elongated rod extending from the rear of the projectile into the surrounding air stream. Deflection of the rod provides the actual steering.

11 Claims, 7 Drawing Figures

STEERING MECHANISM FOR AN EXPLOSIVELY FIRED PROJECTILE

BACKGROUND OF THE INVENTION

1. Field of the Invention

This invention relates to projectile steering mechanisms and, more particularly, to a means for extending an elongated device into the slip stream of a projectile in order to provide steering forces.

2. Description of the Prior Art

Mechanisms for steering a missile or rocket during the flight thereof have long been available in the prior art. For example, U.S. Pat. No. 3,764,091 discloses a steering and propulsion system for a guided missile wherein a guidance head in the nose of the missile seeks out the target and gives continuous signal data in regard to the bearing of the target from the missile. From this and other information relating to the missile flight, control signals are derived for the application to servo-valves of on-board actuators for the purpose of continuously correcting the missile flight to ensure interception of the target by deflections of the fin and defletor nozzle assembly.

Projectiles which have means associated therewith for reducing drag or for stabilizing the projectile after it has been fired are also well known. For example U.S. Pat. No. 656,933 discloses a projectile having a stem portion retracted before firing, which extends from the rear of the projectile after firing and thereafter acts as a drag to cause the projectile to travel nose foremost, thus acting to stabilize the projectile. Means for steering the projectile after firing are not provided, however.

U.S. Pat. No. 2,359,515 discloses a projectile of substantially smaller diameter than the bore of the gun and provided with a tail fin assemblage of fixed fins which is fully extended after firing and acts, inter alia, to increase the steering force leverage on the projectile.

U.S. Pat. Nos. 1,384,868 and 1,537,713 both disclose a bomb adapted to be dropped from an aircraft, the bomb including a controllable drag rudder mounted on an extension fixed rigidly to the bomb. A control element allows the drag rudder to be deflected, thus enabling the bomb to be steered after it is dropped.

U.S. Pat. No. 2,432,421 discloses a bomb having a rear rudder, the angular position of which can be changed only once. The rudder is coupled to an internal lever, the lever being caused to pivot upon receipt of a radio signal. Movement of the lever causes the rudder to be angularly displaced, whereby the bomb travel changes from a vertical descent to a horizontal motion.

Other prior art patents which disclose means for controlling some characteristics of a bomb, missile, rocket or the like are:

U.S. Pat. No. 3,713,607 discloses a spike on the front end of a missile. The spike, a hollow tube, is not for control purposes but used for reducing drag on the missile.

U.S. Pat. No. 3,412,962 discloses an air drag reducing attachment for the rear end of an aircraft and includes a plurality of elongated concentrically nested and relatively telescopingly engaged tubular members.

U.S. Pat. Nos. 1,278,786; 3,292,879; 3,888,175; 3,267,854; 4,228,973; 1,324,433; 2,976,805; 2,589,129 and French Pat. No. 492,123 show various means for stabilizing an in-flight object.

U.S. Pat. Nos. 3,179,052; 2,297,130; and French Pat. No. 1,459,354 disclose mechanisms for reducing drag on an in-flight object.

Although the aforementioned examples of prior art disclose various ways for controlling the drag, stabilizing and steering characteristics of a launched, airborne object, it would be desirable if a simple technique for accurately steering a projectile fired by a gun could be provided. Since the powder charge initially carried with the projectile is in the cartridge shell, the steering mechanism also will be subjected to space and temperature constraints, and thus would have to be operable in that environment.

SUMMARY OF THE PRESENT INVENTION

In brief, arrangements in accordance with the present invention comprise a projectile trajectory correction system, the projectile itself including a unique steering arrangement. The projectile, initially part of a shell cartridge, is fired, and its position is automatically sensed. A corrected trajectory necessary to hit a target is calculated and data commands are transmitted to the projectile. The data command signals are received by an antenna on the projectile. The antenna in turn provides a signal which is fed to the projectile steering mechanism which is deflected in response thereto to steer the projectile onto the correct trajectory. The steering mechanism includes an elongated rod extending from the rear of the projectile into the surrounding air stream. Deflection of the rod provides the actual steering.

DESCRIPTION OF THE DRAWING

A better understanding of the present invention may be had from a consideration of the following detailed description, taken in conjunction with the accompanying drawing in which.

DESCRIPTION OF THE PREFERRED EMBODIMENT

Figure 1:
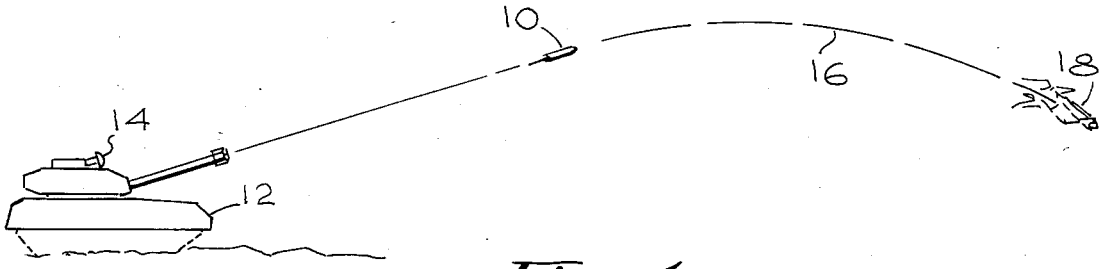
FIG. 1 is a view illustrating the projectile of the present invention on a guided trajectory to a target.

FIG. 1 shows a typical trajectory correction system in which the present invention can be utilized. In particular, projectile 10 with the novel steering mechanism of the present invention is shown as being airborne after being fired from tank 12 or the like as illustrated. Tank 12 includes a sensor/data link device 14 which has the capability of sensing the position of projectile 10 during its flight path. Device 14 also has the capability of calculating the correct trajectory for projectile 10 by sensing the angular error, the roll-angle ambiguity resolution, the initial trajectory, the error vector, the required trajectory and the projected uncorrected error and then transmitting, via a data link, command signals to an antenna mounted on the projectile 10. The flight path of projectile 10 is continuously updated by controlling the projectile steering mechanism, shown in more detail in FIGS. 2–6, such that the flight path coincides with corrected trajectory 16. Projectile 10 is thus steered in a manner such that it intercepts target 18.

Figure 2:
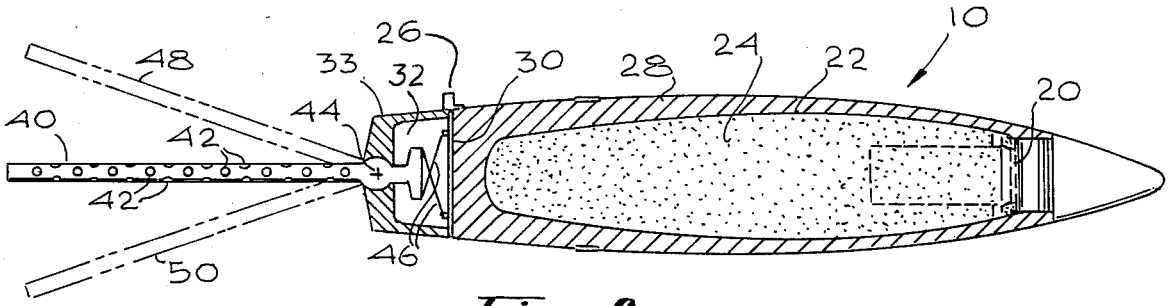
FIG. 2 illustrates a projectile having one particular arrangement of a steering mechanism in accordance with the present invention mounted thereto.
Figure 2A:
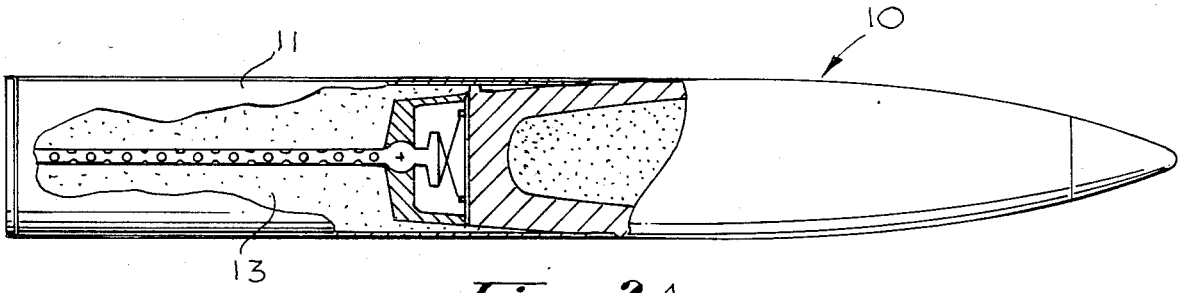
FIG. 2A shows the projectile as part of a cartridge shell.

Referring now to FIG. 2, a partial cross-section of the projectile 10 of the present invention is illustrated. The projectile 10 is shown as it would appear after firing. In order to put the invention in the proper perspective, projectile 10 is shown in FIG. 2A joined to the cartridge shell 11 before firing, the shell 11 being partially broken away to show the firing charge 13. Projectile 10 includes a detonator portion 20, a portion 22 containing explosive charge 24, an antenna 26, a solid area 28, partition member 30 and region 32 wherein a portion of the steering mechanism is located. The steering mechanism of FIG. 2 comprises an elongated member or rod 40, which is hollow and has a plurality of perforations 42 thereon for weight reduction. A housing 33 effectively shields the steering mechanism control elements from the high temperatures (up to 2000° F.) produced when the cartridge is fired. Rod 40 extends from the rear body of projectile 10 and into the slip stream behind the body to provide the steering force. Rod 40 is sufficiently long so that aerodynamic forces acting on it will permit very little angular motion of the rod relative to the slip stream.

The rod is pivotably fastened to projectile 10 at point 44. A controlled torque is applied to rod 40 by actuator elements 46. Appropriate movement of actuator elements 46 angularly positions the rod 40 away from the projectile axis, as indicated by the two positions (48 or 50) illustrated in phantom.

Since rod 40 is rigidly maintained in the slip stream, the torque supplied will cause angular motion of projectile 10 and thus a change in the projectile direction within the atmosphere. This steering effect thus is used to effect desired guidance of projectile 10.

Figure 3:
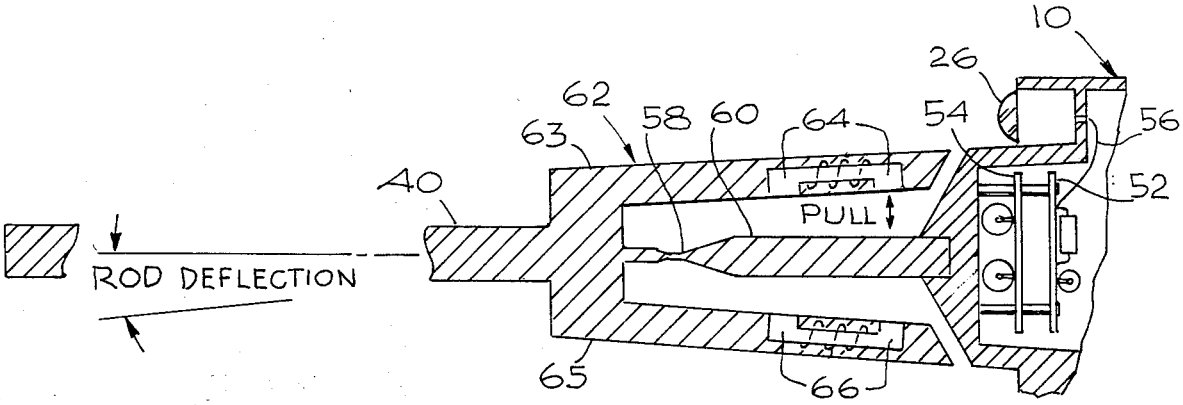
FIG. 3 illustrates specific details of one technique for controlling projectile steering.

FIG. 3 shows a particular technique for deflecting rod 40 to provide steering control for projectile 10. In this detailed sectional view of FIG. 3, an antenna 26 is affixed to the rear portion of projectile 10 and faces the tank 12 from which the projectile was fired. The output signals from antenna 26 are coupled to printed circuit boards 52 and 54 via leads 56. Rod 40 is shown pivotally supported on the necked-down section 58 extending from the inner portion 60 of a motor. The outer portion 62 of the motor is joined to the rod 40, forming a Y-shaped member in section, members 63 and 65 forming the branches of the Y and rod 40 the stem of the Y. A pair of poles 64 and 66 are incorporated in the outer portion 62 of the motor and another pair of poles (not shown) are provided and orientated at 90° to the plane of FIG. 3. Each pole is a permanent magnet and their respective fields are augmented or decremented by current in the windings associated with each of the permanent magnets which results in a pivoting force about the necked-down portion 58. This control current is controlled in response to signals transmitted from data device 14 and developed from antenna 26 and the circuitry of boards 52, 54. The signals from the antenna 26 are coupled to the printed circuit boards 52 and 54 which provide the necessary currents to the windings of poles 64, 66 to generate the desired pivoting force. Although rod 40 can be solid material, it is preferably hollow and perforated to reduce the weight of projectile 10.

The torque mechanism used to control the deflection of rod 40 can be considered to be a radial pole two-phase motor. Magnetic forces are established between the inner portion 60 of the motor, attached to the rear body portion of projectile 10, and the outer portion 62 attached to the rod 40. Thee create a radial torque (vector sense) and rotate or deflect the rod 40 to achieve the angular deflection as shown.

As is well known, a constant magnetic field is created by a permanent magnet and its field flux path is shown by the arrows in FIG. 3. The windings about poles 64 and 66 carry an ac current provided by the printed circuit boards 52 and 54. Poles 64 and 66 and the two poles not shown in the figure have their windings connected either in series or in parallel. The strength of this field at maximum current is equal to that of the permanent magnetic field. If the permanent magnetic field and the ac field are superimposed, the fluxes add in the air gaps between poles 64 and inner portion 60 and cancel in the air gaps between poles 66 and inner portion 60. Thus, a net pull is established from the inner portion 60 to poles 64 and the rod 40 deflects to reduce the gap. The coil circuit of the other pole pair (not shown) is similar to that of the pairs comprising poles 64 and 66 but the current therein is 90° out of phase to that of pole pairs 64 and 66. Thus, there is no ac field between the other two poles. When the projectile 10 has rolled 45°, the currents in coils of poles 64 and 66 and the other coils are equal. The net magnetic pull is in the same direction and the magnitude is also the same. If the projectile rolls to 90°, the current in the coils of poles 64 and 66 is zero and the current in the coils of the other poles is maximum.

Figure 4:
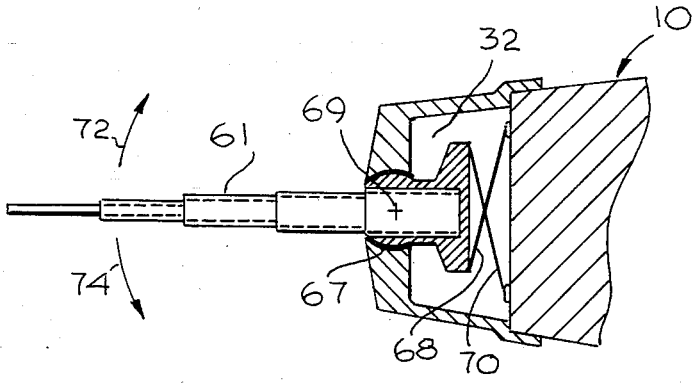
FIGS. 4 and 5 illustrate alternate steering mechanisms in accordance with the invention comprising telescoping rods.

Referring to FIG. 4, an alternate embodiment of the steering rod 40 is illustrated. In particular, rod 61 can be telescoped to the position shown. In this manner, rod 61 may be contained retracted within the cartridge of projectile 10 until firing. After firing the rod 61 extends for steering. In its retracted, telescoped position, rod 61 is positioned in the pivotable member 67, member 67 being pivotable about point 69. Actuator elements 68 and 70 assist in deflecting rod 61 in the direction of reference arrows 74 and 72 respectively.

Figure 5:
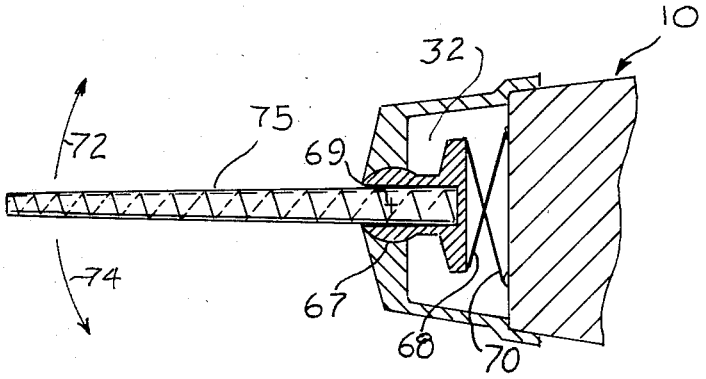

FIG. 5 is similar to FIG. 4 in that an extendable rod 75 is also utilized for steering, the difference being that a spiral wound, extendable element is used as the rod 75.

Figure 6:
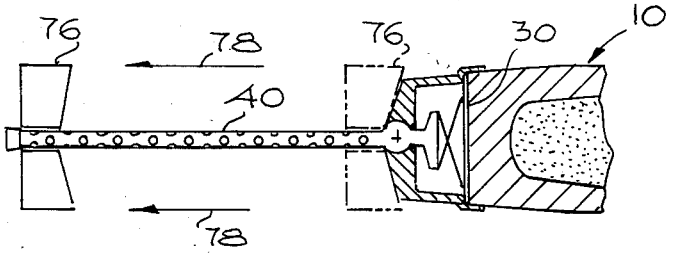
FIG. 6 illustrates a steering mechanism similar to FIG. 2 but modified to include a tail surface for purposes of enhanced aerodynamic effectiveness.

Referring to FIG. 6, rod 40 is like the rod shown in FIG. 2. A tail surface 76 (shown in phantom) is mounted about the rod 40 and is positioned adjacent the body of projectile 10 before firing. After firing, tail surface 76 slides in the direction of arrows 78 to the position illustrated in solid lines and is then locked in place. Tail surface 76 functions to provide additional stability to projectile 10 and increases the steering effect of pivotable rod 40.

It will be understood that the actuator elements such as 46, 68 and 70 in FIGS. 2 and 4–6 (and others, not shown, for developing off-axis deflection of the steering member in other planes) may be connected to a motor such as that shown in FIG. 3 in order to develop the desired deflection of the steering member. The representation of the actuator elements in these figures is symbolic and it will be understood that these may correspond in structure and function to the circuit and motor actuator shown in FIG. 3 and described in conjunction therewith. Other types of actuator elements may also be employed; for example, individual solenoid actuators may be utilized, energized in response to drive signals from the printed circuit.

Although there have been described above specific arrangements of an projectile steering mechanism in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

We claim:

1. A cartridge which includes a projectile having a guidance mechanism incorporated therein and a powder charge for firing the projectile, said cartridge comprising:

a projectile and a shell casing joined together as two separable portions;

a powder charge contained in said shell casing and surrounding a portion of said projectile, the firing of said powder charge causing said projectile to be expelled from the shell casing;

an antenna mounted on said projectile for receiving signals from a remote transmitter; and course correcting means affixed to the projectile, said course correcting means comprising an elongated member extending rearwardly from said projectile into said powder charge and being selectively deflectable relative to the longitudinal axis of said projectile;

said course correcting means further comprising drive means coupled to control the deflection of the elongated member in the air stream formed rearwardly of said projectile in order to steer said projectile in response to signals received from the remote transmitter.

2. The cartridge as defined in claim 1 wherein said elongated member comprises a rod.

3. The cartridge as defined in claim 2 wherein said rod is hollow.

4. The cartridge as defined in claim 3 wherein said rod is perforated.

5. The cartridge as defined in claim 2 wherein the elongated member is stored within the powder charge of the shell casing adjacent the projectile prior to firing of the powder charge.

6. The cartridge as defined in claim 5 wherein the length of the elongated member, prior to firing, is less than the length of the space for the powder charge within said shell casing.

7. The cartridge as defined in claim 6 wherein the elongated member is extendable, after firing, to a length which exceeds the length of the space containing the powder charge.

8. The cartridge as defined in claim 7 wherein said elongated member comprises a telescoping metal rod including a plurality of sections of differing diameters capable of being telescoped together.

9. The cartridge as defined in claim 2 further including a fin element movable along said rod to the distal end thereof for amplifying the effect of deflection of the rod and for stabilizing the projectile in flight.

10. The cartridge as defined in claim 1 wherein said elongated member comprises a stem portion of a member which is Y-shaped in cross-section, said Y-shaped member being pivotably supported on a necked-down section extending from a member mounted to the rear of said projectile, and a plurality of magnetic members each having a winding associated therewith being incorporated in each branch of the Y-shaped member; signals from said antenna varying the current to each winding whereby a pivoting force is applied to said elongated member to thereby control the course of said projectile.

11. A round for firing from a cannon or the like, the projectile of which is steerable in mid-coure, comprising:

a shell casing including a powder charge therein;

a projectile affixed to the shell casing for firing when the round is detonated in a gun;

a steering member extending rearwardly from the projectile into the powder charge and being capable of withstanding the ambient temperatures developed upon firing the round, said steering member being pivotably mounted to the rearward end of the projectile;

means on the projectile for receiving signals indicative of course correction after the projectile is fired;

circuit means responsive to received signals for developing corresponding steering signals; and motor means coupled to the elongated member for deflecting the member angularly relative to the longitudinal axis of the projectile in response to said steering signals for causing the projectile to change course.

* * * * *